US012473110B2

(12) United States Patent
Wu et al.

(10) Patent No.: US 12,473,110 B2
(45) Date of Patent: Nov. 18, 2025

(54) CONTINUOUS HORIZONTAL PACKAGING MACHINE AND PACKAGE OPENING DEVICE THEREOF

(71) Applicant: EZpack Co., Ltd., Taoyuan (TW)

(72) Inventors: Jui-Che Wu, Taoyuan (TW); Ai-Chen Ho-Yeh, Taoyuan (TW); Chun-Hsien Li, Taoyuan (TW)

(73) Assignee: EZpack Co., Ltd., Taoyuan (TW)

( * ) Notice: Subject to any disclaimer, the term of this patent is extended or adjusted under 35 U.S.C. 154(b) by 11 days.

(21) Appl. No.: 18/738,592

(22) Filed: Jun. 10, 2024

(65) Prior Publication Data

US 2024/0409254 A1 Dec. 12, 2024

(30) Foreign Application Priority Data

Jun. 12, 2023 (TW) ..... 112121896

(51) Int. Cl.

| | |
|---|---|
| ***B65B 9/093*** | (2012.01) |
| ***B65B 9/08*** | (2012.01) |
| ***B65B 41/16*** | (2006.01) |
| ***B65B 43/30*** | (2006.01) |
| ***B65B 43/46*** | (2006.01) |
| ***B65B 51/14*** | (2006.01) |

(52) U.S. Cl.

CPC ..... *B65B 9/08* (2013.01); *B65B 9/093* (2013.01); *B65B 41/16* (2013.01); *B65B 43/30* (2013.01); *B65B 43/465* (2013.01); *B65B 51/146* (2013.01)

(58) Field of Classification Search

CPC ..... B65B 9/08; B65B 9/093; B65B 41/16; B65B 43/30; B65B 43/46; B65B 43/465; B65B 51/14; B65B 51/146; B65B 51/303; B65B 61/005; B65B 61/06; B65B 61/28

USPC ..... 53/455, 562, 386.1

See application file for complete search history.

(56) References Cited

U.S. PATENT DOCUMENTS 2,877,609 A * 3/1959 Bodolay et al. ..... B65B 9/093 53/374.6
4,033,096 A * 7/1977 Burgat et al. ..... B65B 43/30 53/571
4,156,334 A * 5/1979 Burgat et al. ..... B65B 43/30 53/385.1

(Continued)

FOREIGN PATENT DOCUMENTS

CN 104843201 A * 8/2015 ..... B65B 43/30
CN 113511373 A * 10/2021 ..... B65B 43/30
JP 04142227 A * 5/1992

*Primary Examiner* — Stephen F. Gerrity
(74) *Attorney, Agent, or Firm* — Blank Rome LLP

(57) ABSTRACT

A package opening device of a continuous horizontal packaging machine includes upper and lower package opening units and a squeezing unit. The upper package opening unit includes two upper slide blocks, and two upper suction members respectively fixed to and driven by the upper slide blocks to relatively move in a transverse direction. The squeezing unit includes a guide rail extending in a horizontal direction perpendicular to the transverse direction, and two pushing blocks slidably disposed on the guide rail and movable relative to each other. The lower package opening unit is lower than the upper package opening unit in a height direction perpendicular to the horizontal and transverse directions, and includes two lower slide blocks, and two lower suction members respectively fixed to and driven by the lower slide blocks to relatively move in the transverse direction.

10 Claims, 15 Drawing Sheets

(56) References Cited

U.S. PATENT DOCUMENTS

| | | | | |
|---|---|---|---|---|
| 4,736,572 | A * | 4/1988 | Fang et al. | B29C 66/43121 53/512 |
| 5,353,573 | A * | 10/1994 | Durrant | B65B 3/02 53/64 |
| 6,272,815 | B1 * | 8/2001 | Todd et al. | B29C 66/0342 53/64 |
| 2012/0151874 | A1 * | 6/2012 | Solano | B65B 51/146 53/268 |

* cited by examiner

CONTINUOUS HORIZONTAL PACKAGING MACHINE AND PACKAGE OPENING DEVICE THEREOF

CROSS-REFERENCE TO RELATED APPLICATION

This application claims priority to Taiwanese Invention Patent Application No. 112121896, filed on Jun. 12, 2023.

FIELD

The present disclosure relates to an apparatus for packaging material, more particularly to a continuous horizontal packaging machine and a package opening device thereof.

BACKGROUND

Referring to FIG. 1, a material discharging bag supporting mechanism for a horizontal packaging machine, as disclosed in Chinese Patent Publication No. CN103523252A, is used to fill a packaging bag 9 with a filling materials, and includes a fixed plate 91 located above the packaging bag 9, a lower hopper 92 movable up and down relative to the fixed plate 91, two bag supporting pieces 93 mounted to an underside of the lower hopper 92, and two suction members 94 respectively located on left and right sides of the packaging bag 9 and driven by an air cylinder (not shown) to move relative to the packaging bag 9. By using the suction members 94 to suck two opposite surfaces of an upper portion of the packaging bag 9 and pull them outwardly so as to open the mouth of the packaging bag 9, and then driving the lower hopper 92 to move downwardly so as to extend the bag supporting pieces 93 into the packaging bag 9 through the mouth thereof, the filling material can be filled into the packaging bag 9 through the lower hopper 92. Therefore, there will be no accidental spillage of the filling material during filling.

However, the method of only relying on the suction members 94 to suck the packaging bag 9 can only open the upper portion thereof, while a lower portion of the packaging bag 9 may not be expanded and has a flat shape. As a result, the packaging bag 9 will be bent in a middle portion thereof, thereby resulting in poor bag opening effect.

SUMMARY

Therefore, an object of the present disclosure is to provide a continuous horizontal packaging machine that can alleviate at least one of the drawbacks of the prior art.

Accordingly, the continuous horizontal packaging machine of this disclosure is suitable for forming a continuous folded film material into a plurality of packages, for filling each package with a filling material, and for sealing each package filled with the filling material. The continuous horizontal packaging machine comprises a horizontal packaging system. The horizontal packaging system includes a base, a clamping and moving device, a vertical sealing device, a film cutting device, a package receiving device, a package opening device, a filling device, and a top sealing device.

The base has a feed end, and a discharge end opposite to the feed end in a horizontal direction. The clamping and moving device is disposed on the base, and includes two roller shafts extending in a height direction perpendicular to the horizontal direction. The roller shafts are rotatable in opposite directions to clamp therebetween the folded film material, and are configured to intermittently move the folded film material in the horizontal direction. The vertical sealing device is disposed on the base and is located between the feed end and the clamping and moving device. The vertical sealing device includes two side heating blocks extending in the height direction and relatively movable toward each other in a transverse direction perpendicular to the horizontal and height directions for hot pressing lateral sides of the folded film material.

The film cutting device is disposed on the base, is located between the clamping and moving device and the discharge end, and is configured to cut the folded film material to form the packages. The package receiving device is configured to drive the packages to intermittently move in the horizontal direction, and includes two slide seats spaced apart in the transverse direction and extending in the horizontal direction, and a driven rod interconnecting the slide seats and configured to drive the slide seats to move toward or away from each other in the transverse direction so as to clamp or release the packages. The slide seats are further driven to move back and forth in the horizontal direction for conveying the packages.

The package opening device is disposed on the base and is located between the film cutting device and the discharge end. The package opening device is configured to open each package, and includes an upper package opening unit having two upper suction members relatively movable in the transverse direction, a squeezing unit having two pushing blocks relatively movable in the horizontal direction, and a lower package opening unit having two lower suction members relatively movable in the transverse direction and lower than the two upper suction members in the height direction.

The filling device is disposed on the base, is located between the package opening device and the discharge end, and is configured to fill each package with the filling material. The top sealing device is disposed on the base, is located between the filling device and the discharge end, and includes two top heating blocks relatively movable in the transverse direction for hot pressing a top end of each package.

Another object of this disclosure is to provide a package opening device of a continuous horizontal packaging machine that can alleviate at least one of the drawbacks of the prior art.

Accordingly, the package opening device of a continuous horizontal packaging machine of this disclosure comprises an upper package opening unit, a squeezing unit, and a lower package opening unit. The upper package opening unit includes two upper slide blocks relatively movable in a transverse direction, and two upper suction members respectively fixed to and driven by the upper slide blocks to relatively move in the transverse direction. The squeezing unit includes a guide rail extending in a horizontal direction perpendicular to the transverse direction, and two pushing blocks slidably disposed on the guide rail and movable relative to each other. The lower package opening unit is lower than the upper package opening unit in a height direction perpendicular to the horizontal and transverse directions, and includes two lower slide blocks relatively movable in the transverse direction, and two lower suction members respectively fixed to and driven by the lower slide blocks to relatively move in the transverse direction.

BRIEF DESCRIPTION OF THE DRAWINGS

Other features and advantages of the disclosure will become apparent in the following detailed description of the embodiment with reference to the accompanying drawings. It is noted that various features may not be drawn to scale.

DETAILED DESCRIPTION

Figure 1:
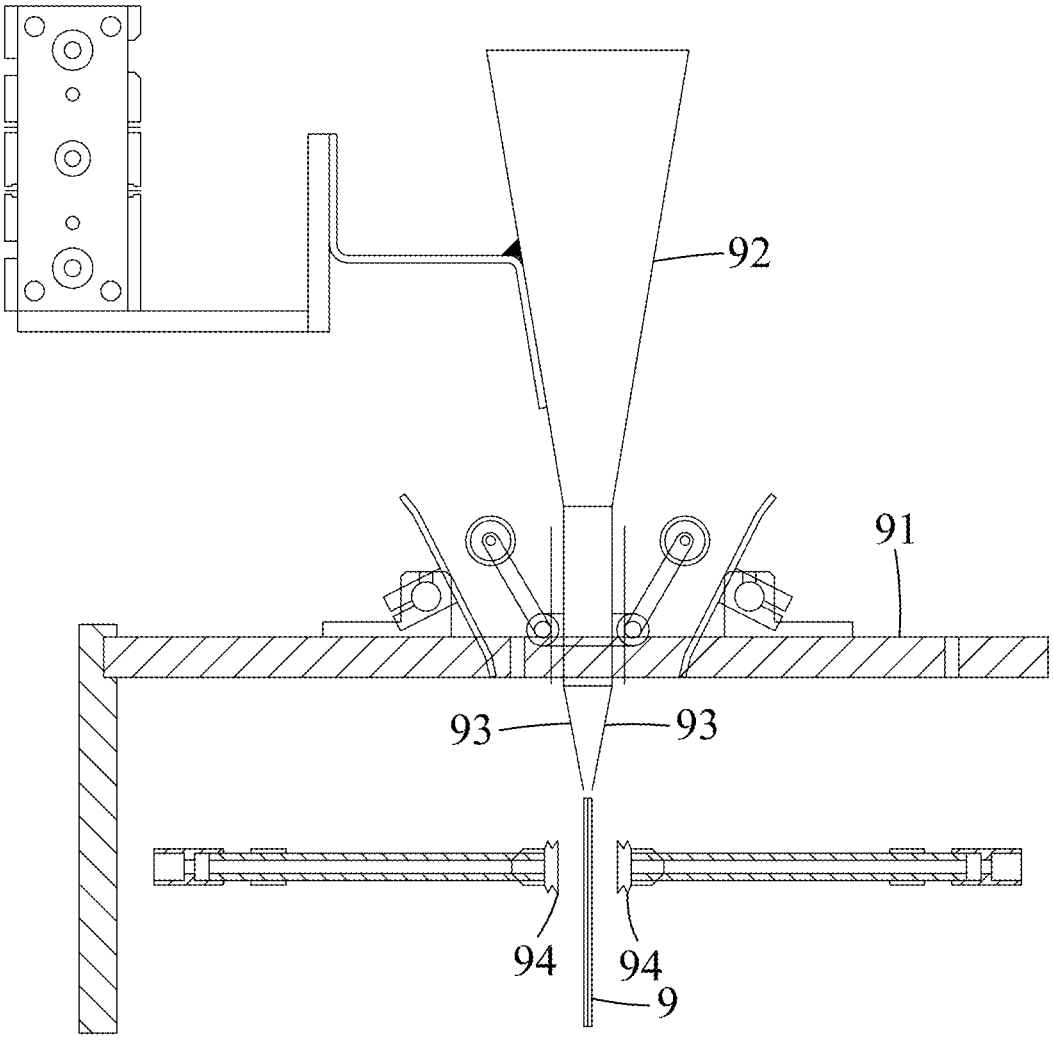
FIG. 1 PRIOR ART
FIG. 1 is a sectional view of a material discharging bag supporting mechanism for a horizontal packaging machine disclosed in Chinese Patent Publication No. CN103523252A.
Figure 2:
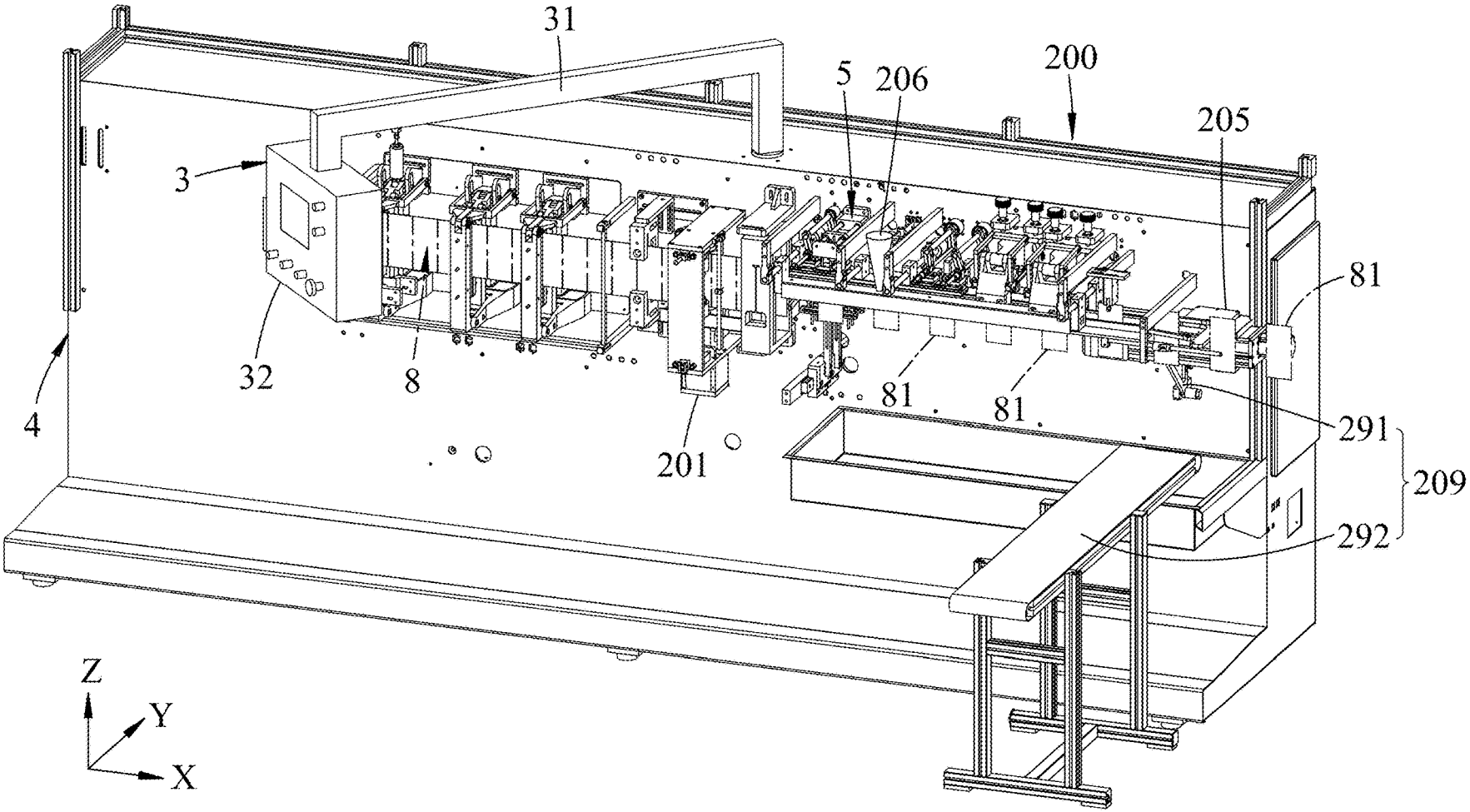
FIG. 2 is a perspective view of a continuous horizontal packaging machine according to an embodiment of the present disclosure, but with a film conveying mechanism being omitted.
Figure 3:
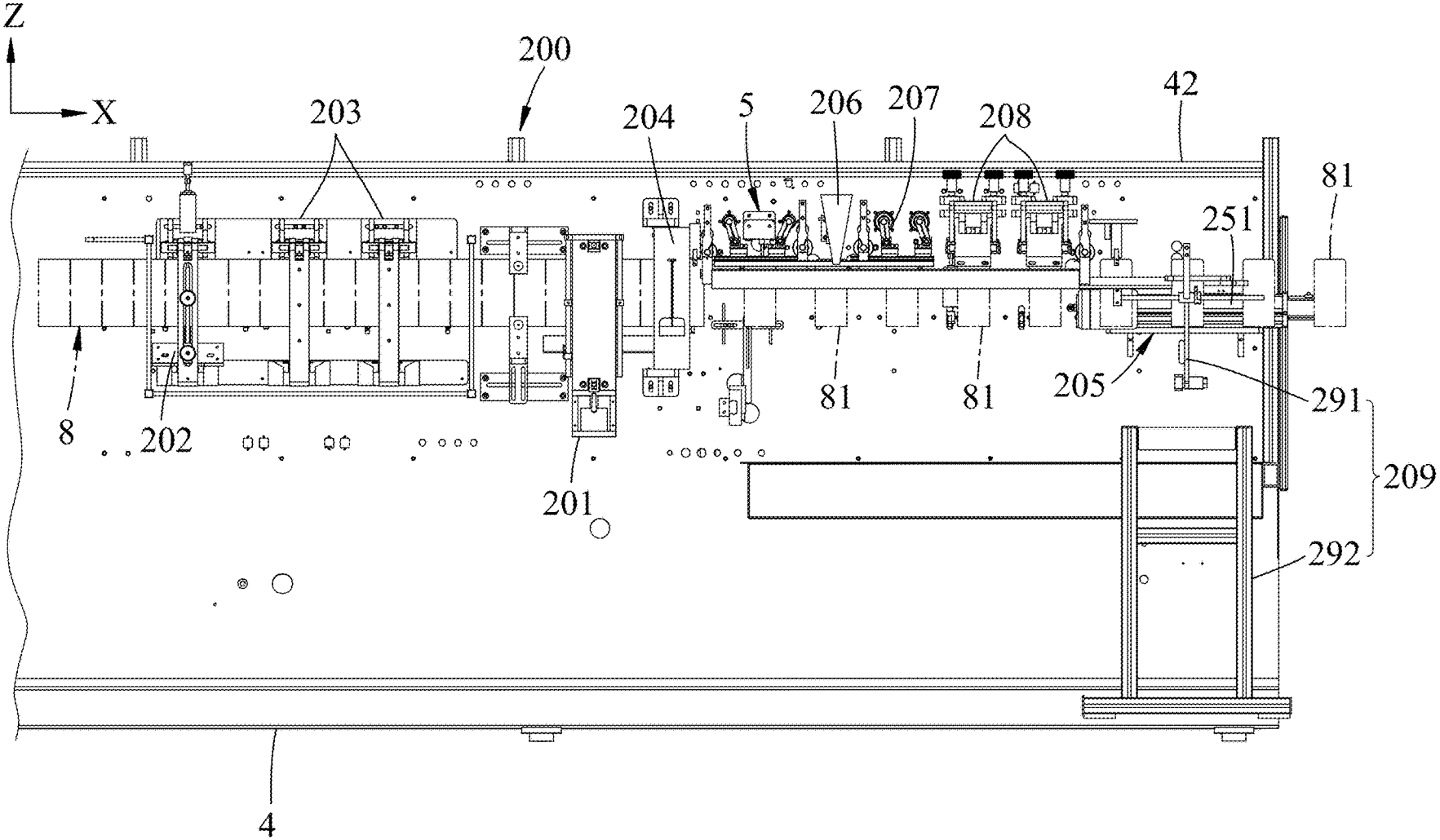
FIG. 3 is a fragmentary schematic front view of the embodiment.
Figure 4:
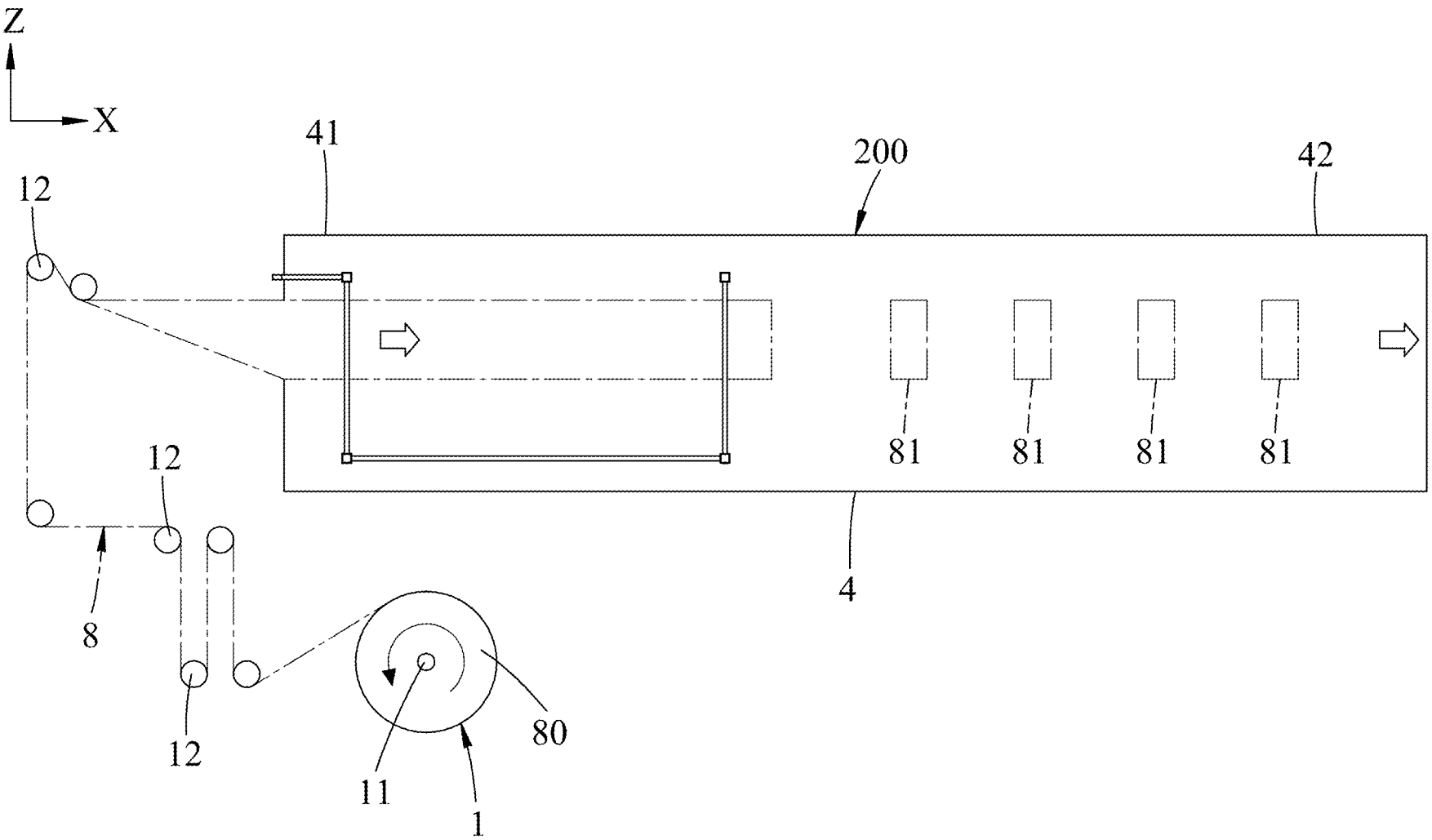
FIG. 4 is a schematic diagram of a packaging process of the embodiment.

Referring to FIGS. 2 to 4, a continuous horizontal packaging machine according to an embodiment of this disclosure is suitable for forming a continuous folded film material 8 into a plurality of packages 81, for filling each package 81 with a filling material (not shown), and for sealing each package 81 filled with the filling material. The film material 8 is a plastic film material pulled out from a film material roll 80 continuously without interruption, and has an outer surface printed with patterns, text and the like. The filling material is, for example, but not limited to, a food product, a nutritional product, or a skin care product, and may be in the form of liquid, granules, powder, or a mixture thereof. Each package 81 may be a four-side sealed flat bag, a three-side sealed stand-up bag, or other packaging. The package 81 is illustrated as a four-side sealed flat bag in this embodiment. The continuous horizontal packaging machine of this embodiment comprises a film conveying mechanism 1, a horizontal packaging system 200 adjacent to the film conveying mechanism 1, and a control system 3 for controlling the operations of the film conveying mechanism 1 and the horizontal packaging system 200.

The film conveying mechanism 1 includes a feed shaft 11 rotatable about its own axis and provided for the film material roll 80 to be sleeved thereon, and a plurality of spaced-apart rotating rollers 12 for the film material 8 to be wound thereon. When the feed shaft 11 and the rotating rollers 12 are rotated, the rotating rollers 12 can convey the film material 8 pulled out from the film material roll 80 and then fold in half the film material 8 before being sent into the horizontal packaging system 200.

The horizontal packaging system 200 includes a base 4, a clamping and moving device 201, a bottom sealing device 202, a vertical sealing device 203, a film cutting device 204, a package receiving device 205, a package opening device 5, a filling device 206, a package expansion device 207, a top sealing device 208, and a discharge device 209.

The base 4 has a feed end 41 adjacent to the film conveying mechanism 1, and a discharge end 42 opposite to the feed end 41 in a horizontal direction (X). In this embodiment, the horizontal direction (X) extends in a left-right direction.

Figure 5:
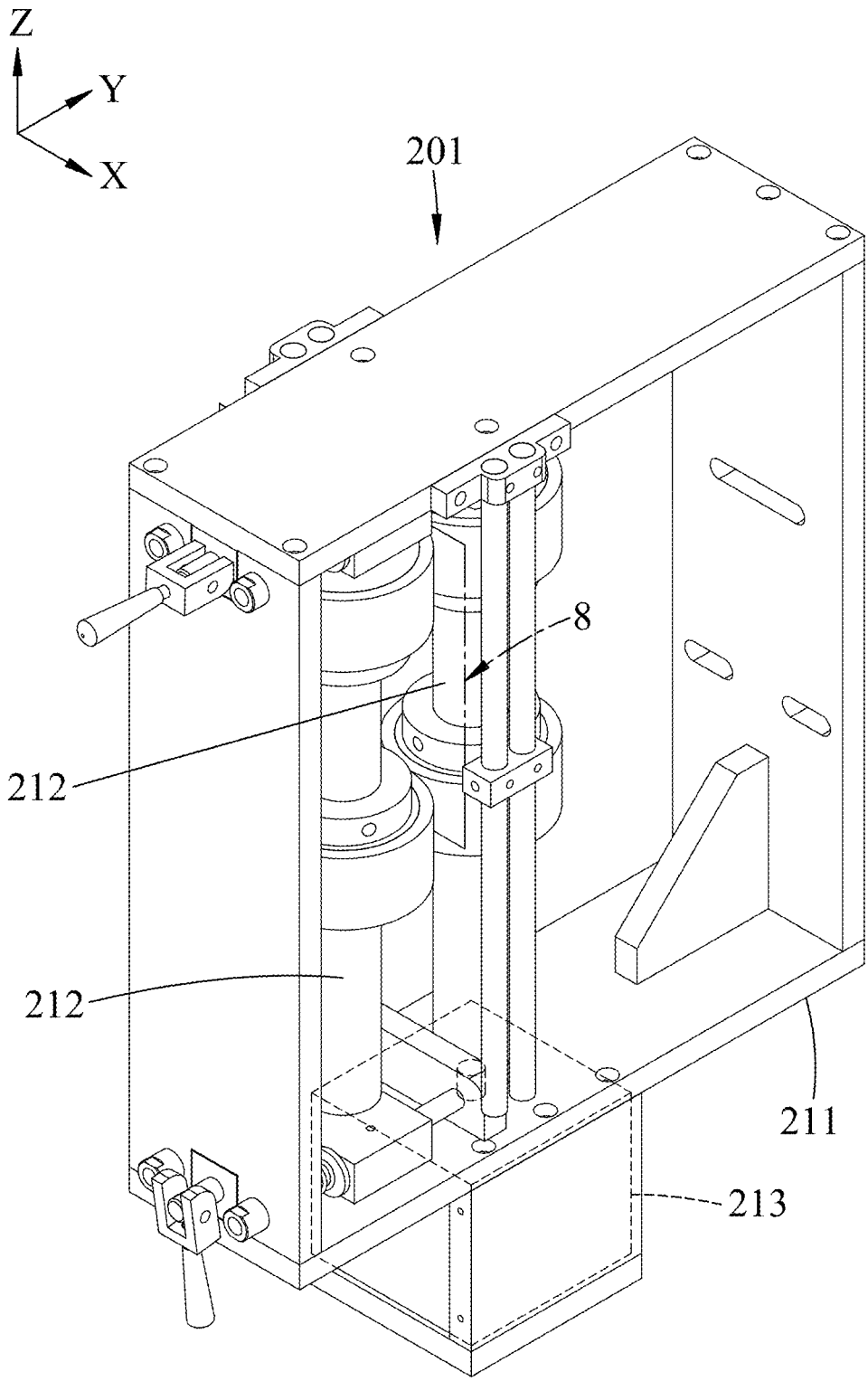
FIG. 5 is a perspective view of a clamping and moving device of the embodiment for clamping and moving a film material.

Referring to FIG. 5, in combination with FIGS. 3 and 4, the clamping and moving device 201 is mounted on the base 4, and is located in the middle position between the feed end 41 and the discharge end 42. The clamping and moving device 201 includes a mounting frame 211 fixed to the base 4, two roller shafts 212 mounted within the mounting frame 211 and extending in a height direction (Z) perpendicular to the horizontal direction (X), and a drive member 213 connected to one of the roller shafts 212. The drive member 213 is driven by electricity to intermittently drive one of the roller shafts 212 to rotate, which in turn drives the other roller shaft 212 to rotate in opposite direction, so as to clamp therebetween the folded film material 8 and drive the folded film material 8 to intermittently move in the horizontal direction (X). The drive member 213 of this embodiment is, for example, but not limited to, a servo motor, as long as it can drive relative rotation of the roller shafts 212 by electricity.

Figure 6:
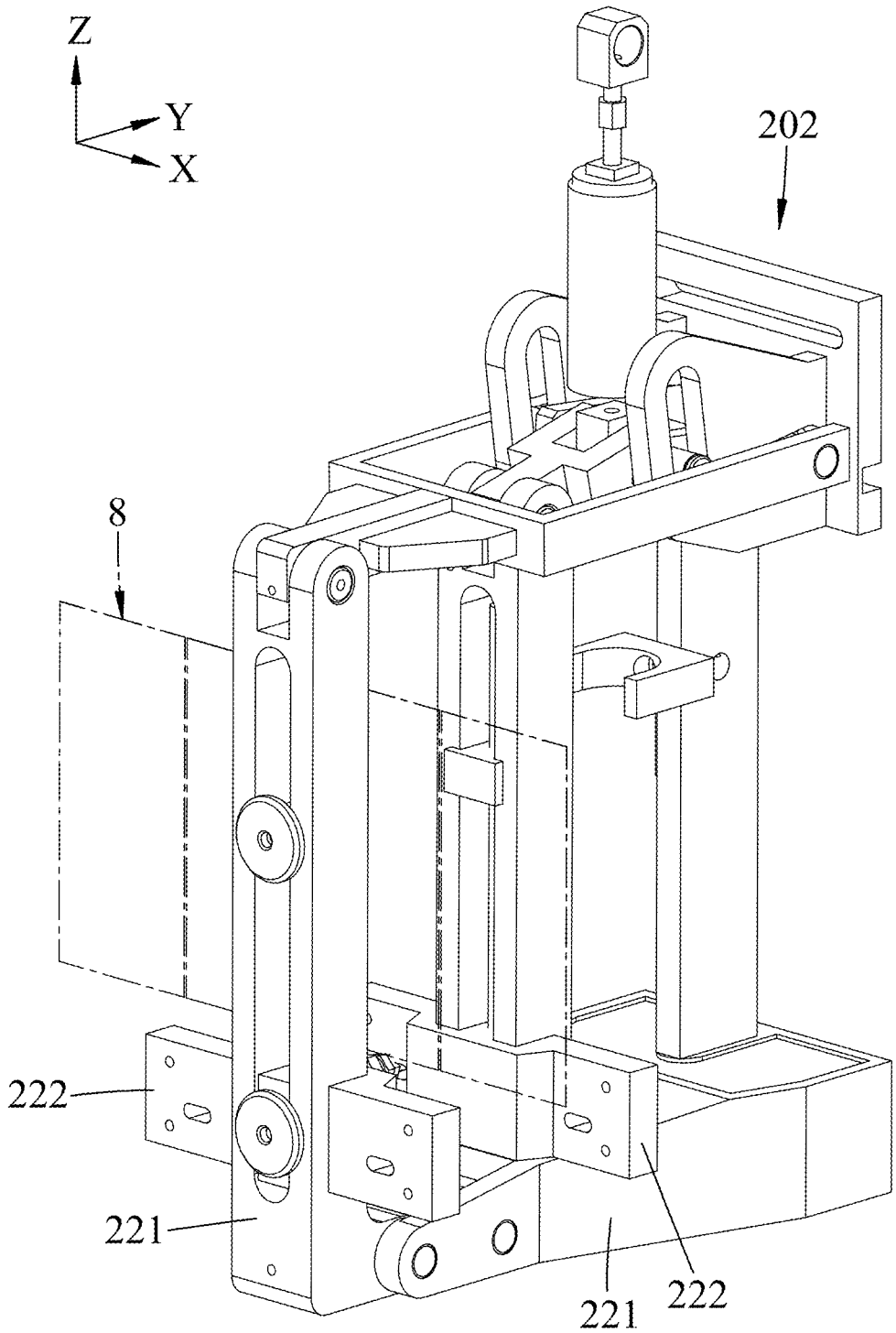
FIG. 6 is a perspective view of a bottom sealing device of the embodiment for hot pressing a bottom end of the film material.

Referring to FIG. 6, in combination with FIGS. 3 and 4, the bottom sealing device 202 is mounted on the base 4, and is located between the feed end 41 and the clamping and moving device 201. The bottom sealing device 202 includes two bottom sealing clamping seats 221 pivotable relative to each other, and two bottom heating blocks 222 respectively fixed to the bottom sealing clamping seats 221 and extending in the horizontal direction (X). When the bottom sealing clamping seats 221 are driven to pivot relative to each other through a cam mechanism (not shown), the bottom heating blocks 222 are driven to move close to each other in a transverse direction (Y) perpendicular to the horizontal direction (X) and the height direction (Z), so as to clamp therebetween the folded film material 8 and to press and heat a bottom end thereof, thereby thermally welding the bottom end of the folded film material 8. In some variations, for example, the package 81 is a three-side sealed stand-up bag, the bottom sealing device 202 of the horizontal packaging system 200 may be omitted. In this embodiment, the transverse direction (Y) extends in a front-rear direction.

Figure 7:
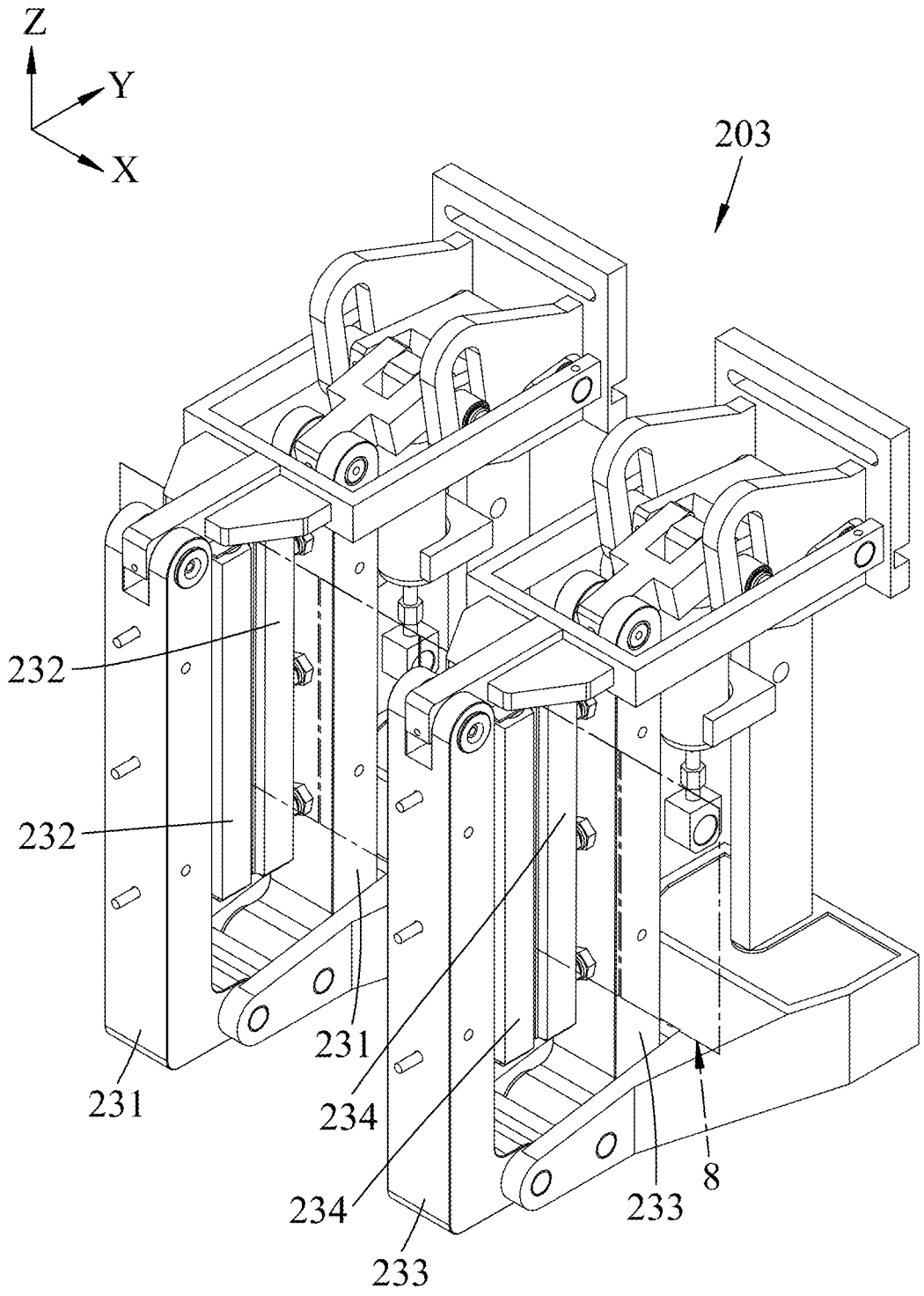
FIG. 7 is a perspective view of a vertical sealing device of the embodiment for hot pressing lateral sides of the film material.

Referring to FIG. 7, in combination with FIGS. 3 and 4, the vertical sealing device 203 is mounted on the base 4, and is located between the bottom sealing device 202 and the clamping and moving device 201. The vertical sealing device 203 includes two vertical sealing clamping seats 231 pivotable relative to each other, two side heating blocks 232 respectively fixed to the vertical sealing clamping seats 231 and extending in the height direction (Z), two side sealing clamping seats 233 spaced apart from the vertical sealing clamping seats 231 in the horizontal direction (X) and pivotable relative to each other, and two side pressing blocks 234 respectively fixed to the side sealing clamping seats 233 and extending in the height direction (Z). When the vertical sealing clamping seats 231 are driven to pivot relative to each other through a cam mechanism (not shown), the side heating blocks 232 are driven to move toward each other in the transverse direction (Y), so as to clamp the folded film material 8 therebetween and hot press the lateral sides thereof, thereby thermally welding the lateral sides of the folded film material 8 (i.e., hot vertical sealing). Then, when the side sealing clamping seats 233 are driven to pivot relative to each other through a cam mechanism (not shown), the side pressing blocks 234 are driven to move toward each other in the transverse direction (Y), so as to clamp and press the lateral sides of the folded film material 8 therebetween (i.e., cold vertical sealing), thereby improving the flatness of the lateral sides of the folded film material 8 after thermal welding. In some variations, the side sealing clamping seats 233 and the side pressing blocks 234 of the vertical sealing device 203 may be omitted.

Figure 8:
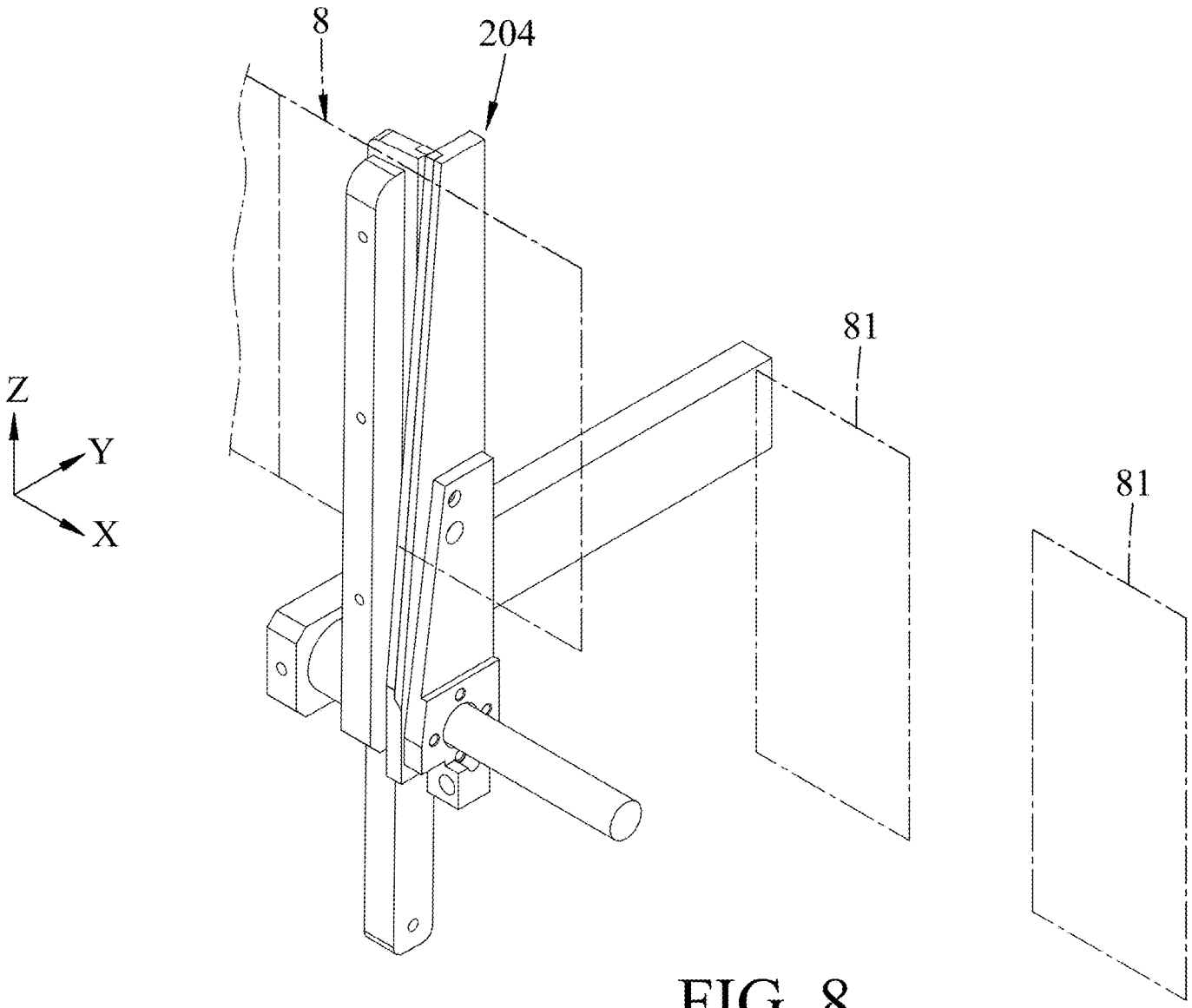
FIG. 8 is a perspective view of a film cutting device of the embodiment for cutting the film material to form a plurality of packages.

Referring to FIG. 8, in combination with FIG. 3, the film cutting device 204 is mounted on the base 4, and is located between the clamping and moving device 201 and the discharge end 42. The film cutting device 204 is configured to cut the folded film material 8 so as to form the packages 81. The film cutting device 204 of this embodiment is a scissor which cuts the folded film material 8 in the height direction (Z) at every predetermined length in the horizontal direction (X) to form a rectangular package 81. In some variations, the film cutting device 204 may be a cutter having a predetermined shape which can cut the folded film material 8 to form a non-rectangular package 81. Therefore, the shape of each package 81 is not limited to what is disclosed in this embodiment.

Figure 9:
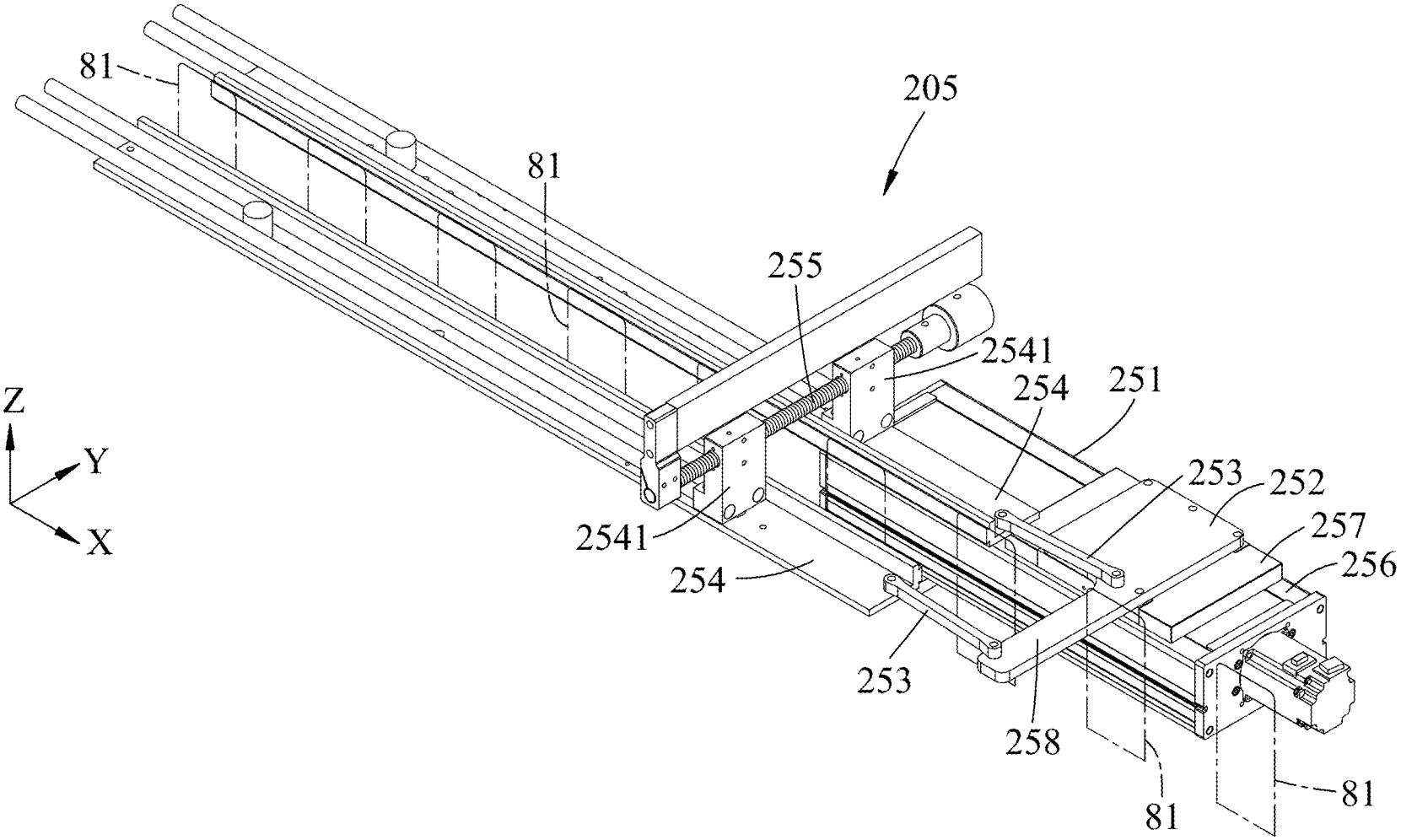
FIG. 9 is a perspective view of a package receiving device of the embodiment for driving the packages to intermittently move in a horizontal direction.
Figure 10:
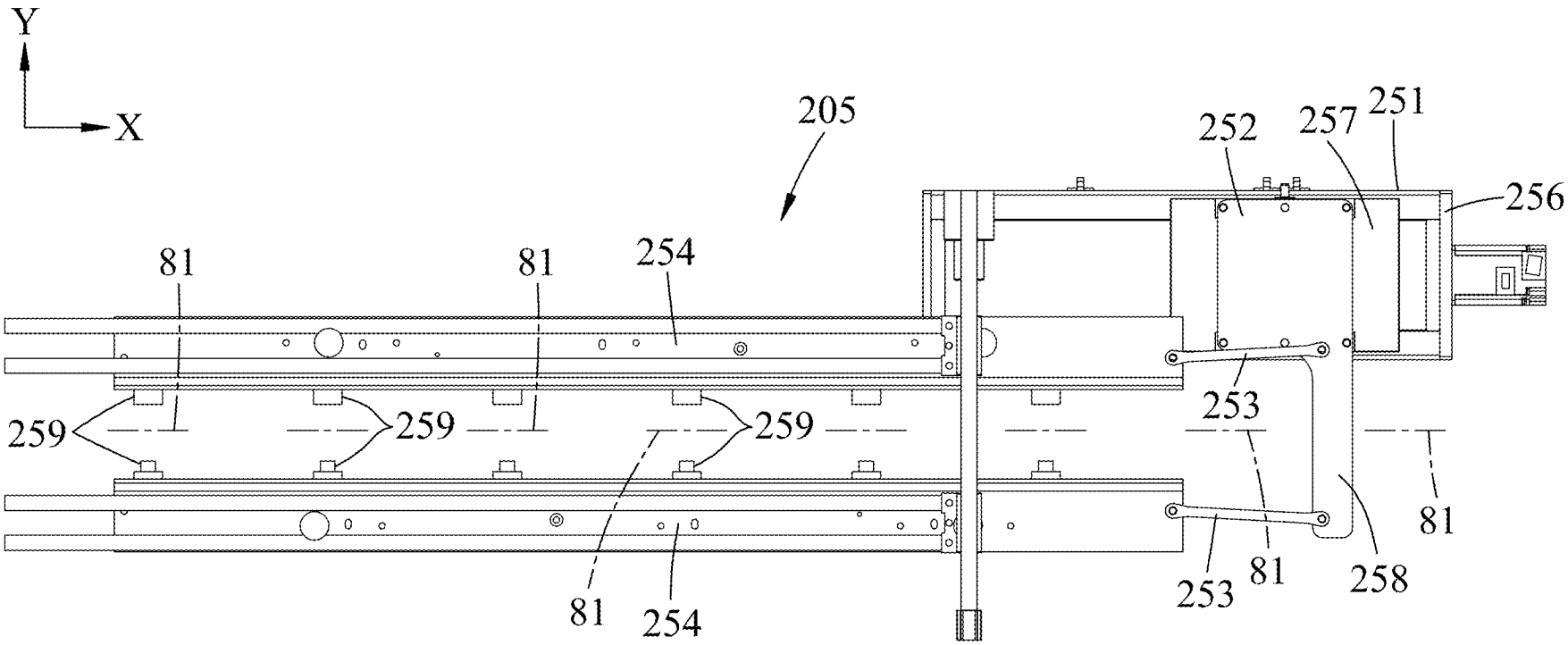
FIG. 10 is a schematic top view of FIG. 9, illustrating a plurality of pairs of press members of the package receiving device for clamping and releasing the packages.

Referring to FIGS. 9 and 10, in combination with FIG. 3, the package receiving device 205 is mounted on the base 4, and is located generally between the film cutting device 204 and the discharge end 42. The package receiving device 205 is configured to drive the cut packages 81 to intermittently move in the horizontal direction (X) for subsequent packaging processes.

The package receiving device 205 includes an electrically powered driver 251, a connecting plate 252 fixed to the driver 251, two spaced-apart pull rods 253, two slide seats 254 spaced apart in the transverse direction (Y) and extending in the horizontal direction (X), and a driven rod 255 interconnecting the sliding seats 254. The driver 251 has a drive body 256, and a carrier 257 slidably disposed on the drive body 256 in the horizontal direction (X). The driver 251 is, for example, but not limited to, a servo motor. The connecting plate 252 has an arm 258 protruding out of the driver 251 in the transverse direction (Y). One of the pull rods 253 has one end pivotally connected to a proximal end of the arm 258 which is proximate to the driver 251, and the other end pivotally connected to one of the slide seats 254. The other pull rod 253 is pivotally connected to a distal end of the arm 258 which is distal to the driver 251, and the other end pivotally connected to the other slide seat 254. Multiple pairs of press members 259 are mounted on the slide seats 254, are spaced apart from each other in the horizontal direction (X), and correspond in position to the packages 81. Each pair of the press members 259 uses a spring pin principle to clamp and release the corresponding package 81. Since the detailed construction and linkage manner of each pair of the press members 259 are known in the art, and have many variations, those with ordinary skilled in the art can deduce the expanded details based on the above description, so that no further explanation will be provided herein.

The driven rod 255 has left and right hand threads opposite to each other. Each slide seat 254 has an L-shaped member 2541 threadedly connected to a respective one of the left and right hand threads of the driven rod 255. By driving the driven rod 255 to rotate about its own axis, the slide seats 254 can be driven to move toward or away from each other in the transverse direction (Y) through the L-shaped members 2541 thereof so as to clamp or release the packages 81. Furthermore, through forward and reverse rotation of the rotor of the drive body 256, the carrier 257 can be driven to move back and forth along the length of the drive body 256, and the pull rods 253 can be driven by the carrier 257 to pivot and move the slide seats 254 back and forth in the horizontal direction (X). As such, the slide seats 254 can simultaneously convey the packages 81 to intermittently move toward the discharge end 42 in the horizontal direction (X) and be discharged one by one from the discharge end 42.

Figure 11:
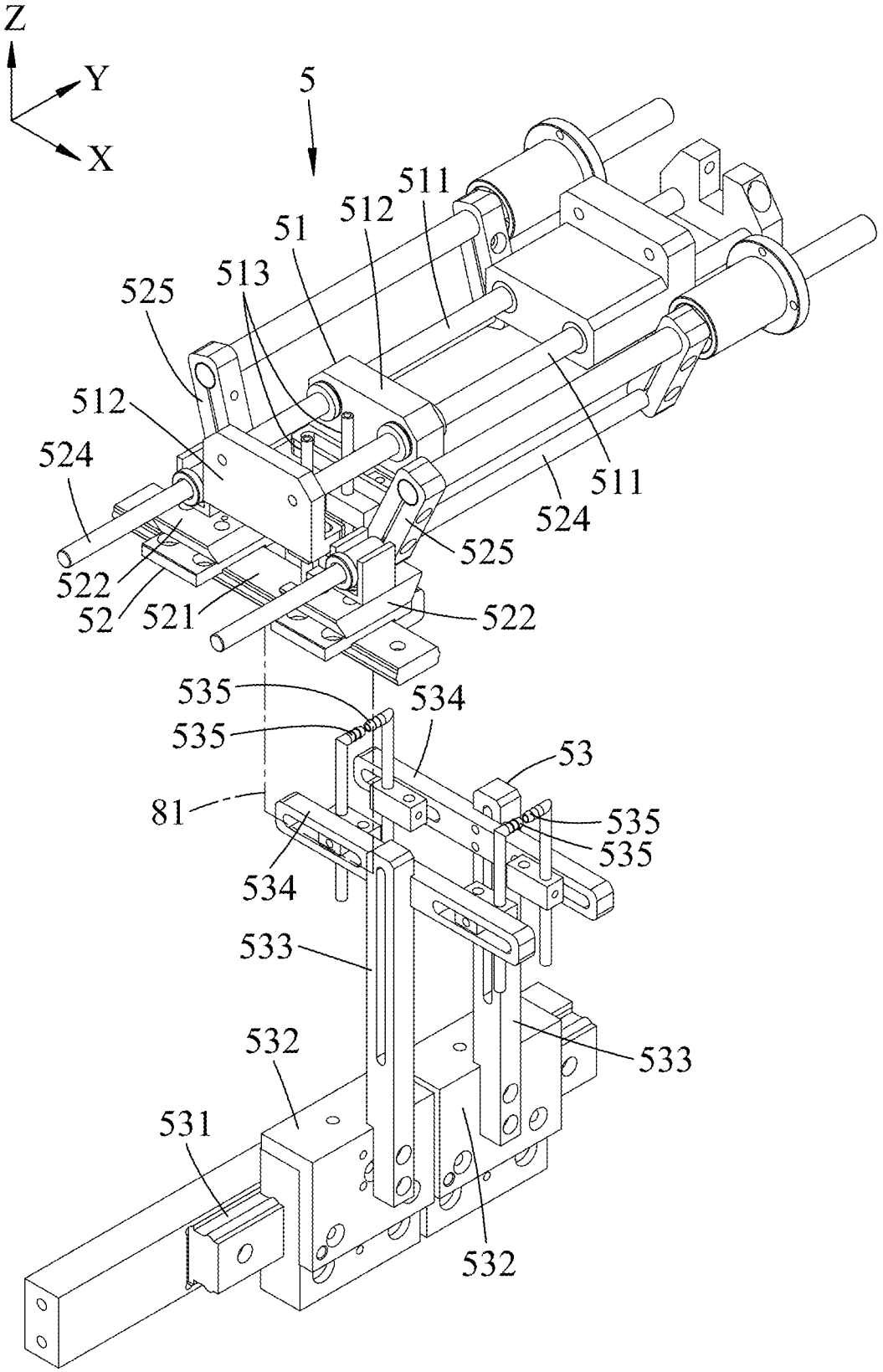
FIG. 11 is a perspective view of a package opening device of the embodiment for opening each package.
Figure 12:
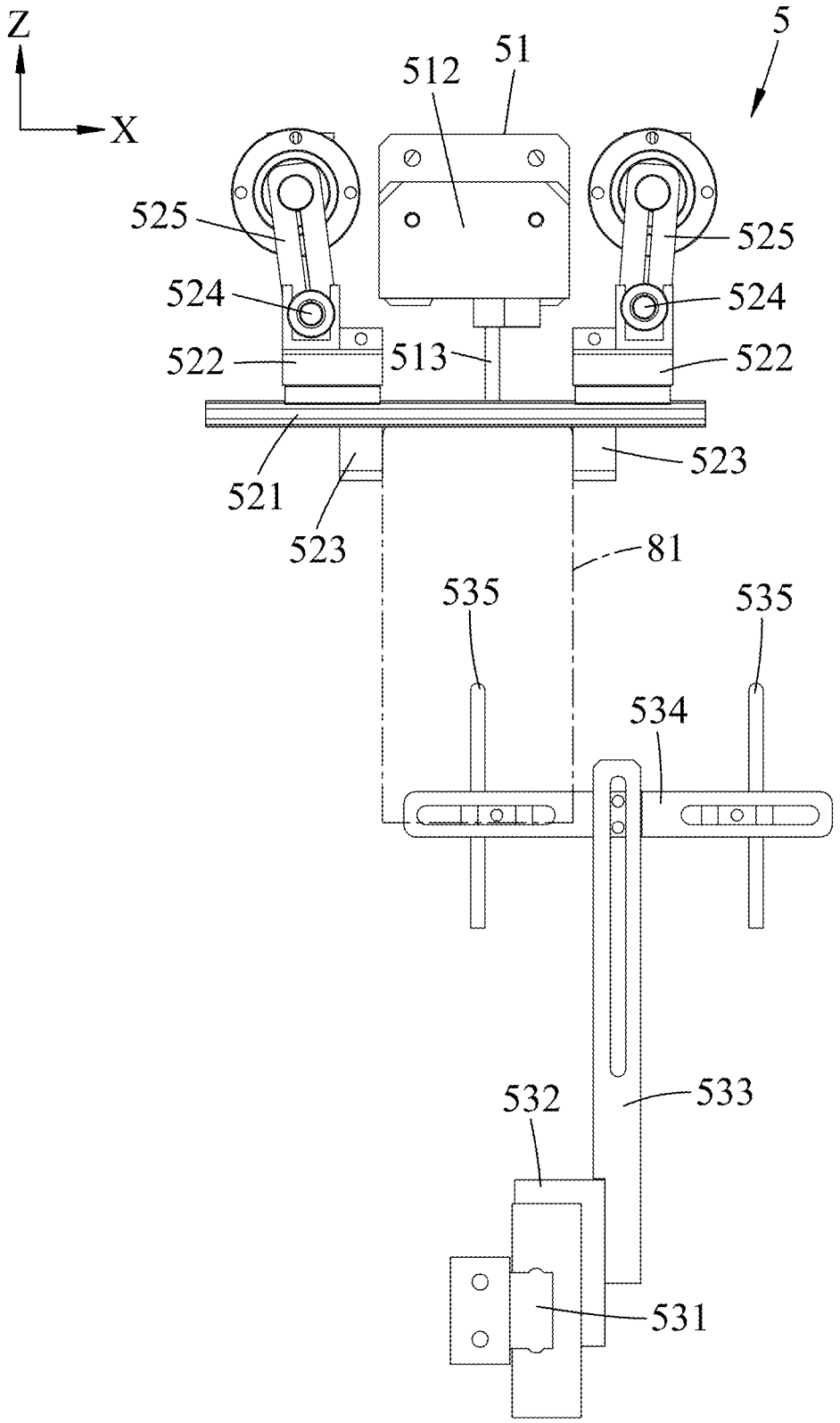
FIG. 12 is a schematic front view of FIG. 11, illustrating a squeezing unit and a lower package opening unit of the package opening device.
Figure 13:
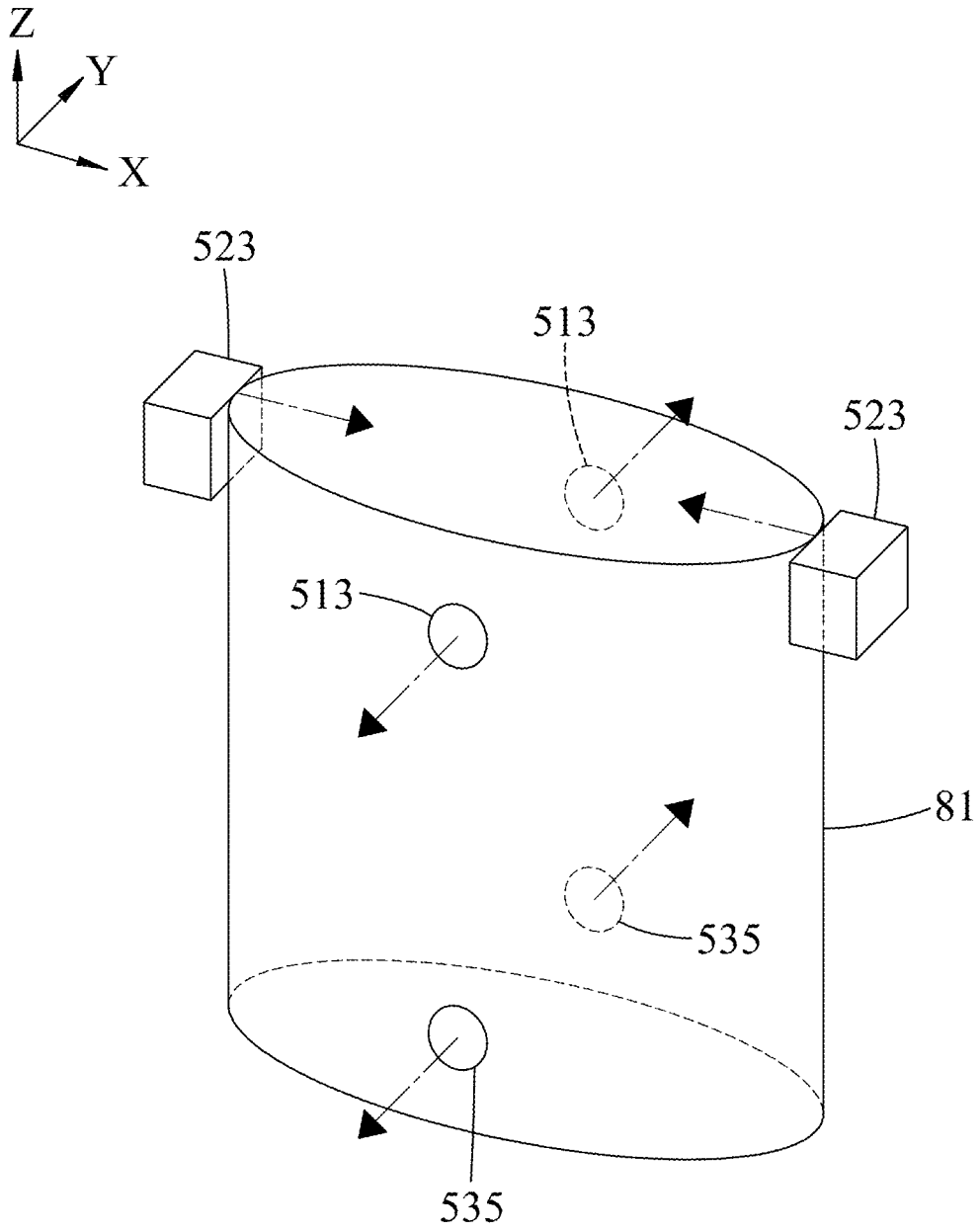
FIG. 13 is a diagram illustrating how the package is opened by synchronous action of two upper suction members, two lower suction members, and two pushing blocks of the package opening device.

Referring to FIGS. 11 to 13, in combination with FIG. 3, the package opening device 5 is disposed on the base 4, and is located between the film cutting device 204 and the discharge end 42. The package opening device 5 is configured to open each package 81, and includes an upper package opening unit 51, a squeezing unit 52 adjacent to the upper package opening unit 51, and a lower package opening unit 53 lower than the upper package opening unit 51 and the squeezing unit 52 in the height direction (Z).

The upper package opening unit 51 includes two parallel shafts 511 extending in the transverse direction (Y), two upper slide blocks 512 mounted on the shafts 511 and relatively movable in the transverse direction (Y), and two upper suction members 513 respectively fixed to the upper slide blocks 512. Each upper suction member 513 is composed of a long rod and a suction body. Due to the viewing angle, only the long rod of each upper suction member 513 is visible in FIG. 11, and the suction body of each upper suction member 513 is shown as a circle in FIG. 13. One of the upper slide blocks 512 is slidably movable along the length of the shafts 511, while the other upper slide block 512 is fixed to one ends of the shafts 511. The upper slide blocks 512 can be actuated to drive the upper suction members 513 to relatively move toward each other in the transverse direction (Y) and suck an upper portion of each package 81.

The squeezing unit 52 includes a guide rail 521 extending in the horizontal direction (X), two guide seats 522 slidably disposed on the guide rail 521, two pushing blocks 523 fixed to and movable along with the guide seats 522, two elongated rods 524 respectively extending through the guide seats 522 in the transverse direction (Y) and located on two opposite sides of the upper package opening unit 51, and two substantially U-shaped movable rods 525 respectively sleeved on the elongated rods 524. When the movable rods 525 are driven to pivot relative to each other through a cam mechanism (not shown), the pushing blocks 523 are driven to move toward each other through the guide seats 522, so as to squeeze left and right sides of each package 81.

The lower package opening unit 53 includes a slide rail 531 extending in the transverse direction (Y), two lower slide blocks 532 slidably disposed on the slide rail 531, two vertical rods 533 respectively fixed to and extending upwardly from the lower slide blocks 532 in the height direction (Z), two horizontal rods 534 respectively fixed to the vertical rods 533 and extending in the horizontal direction (X), and two sets of spaced-apart lower suction members 535 fixed to the transverse rods 534. Each set of the lower suction members 535 includes two suction members 535. When the lower slide blocks 532 are driven to move toward each other, the lower suction members 535 are, in turn, driven by the lower slide blocks 532 to relatively move toward each other in the transverse direction (Y) through the transverse rods 534. In this embodiment, only one set of the lower suction members 535 will be used to suck a lower portion of each package 81. In some variations, for example, if the width of each package 81 is greater than 140 mm, two sets of the lower suction members 535 will then be used at the same time to suck the lower portion of each package 81.

The package opening device 5 of this disclosure utilizes the upper suction members 513 to suck front and back surfaces of the upper portion of each package 81, the lower suction members 535 to suck front and back surfaces of the lower portion of each package 81, and the pushing blocks 523 to squeeze the left and right sides of each package 81. Through the synchronous action of the above components, the expansion of the upper and lower portions and the left and right sides of each package 81 can be ensured to thereby prevent the bending of each package 81 in the middle portion thereof. Therefore, the package opening effect of this disclosure is better than the prior art.

Referring again to FIGS. 2 and 3, the filling device 206 is disposed on the base 4, and is located between the package opening device 5 and the discharge end 42. The filling device 206 is configured to fill each package 81 with the filling material. The filling device 206 may be, but not limited to, a funnel-shaped hopper. Since the filling device 206 is known in the art, and has many variations, those with ordinary skilled in the art can deduce the expanded details based on the above description, so that no further explanation will be provided herein.

Figure 14:
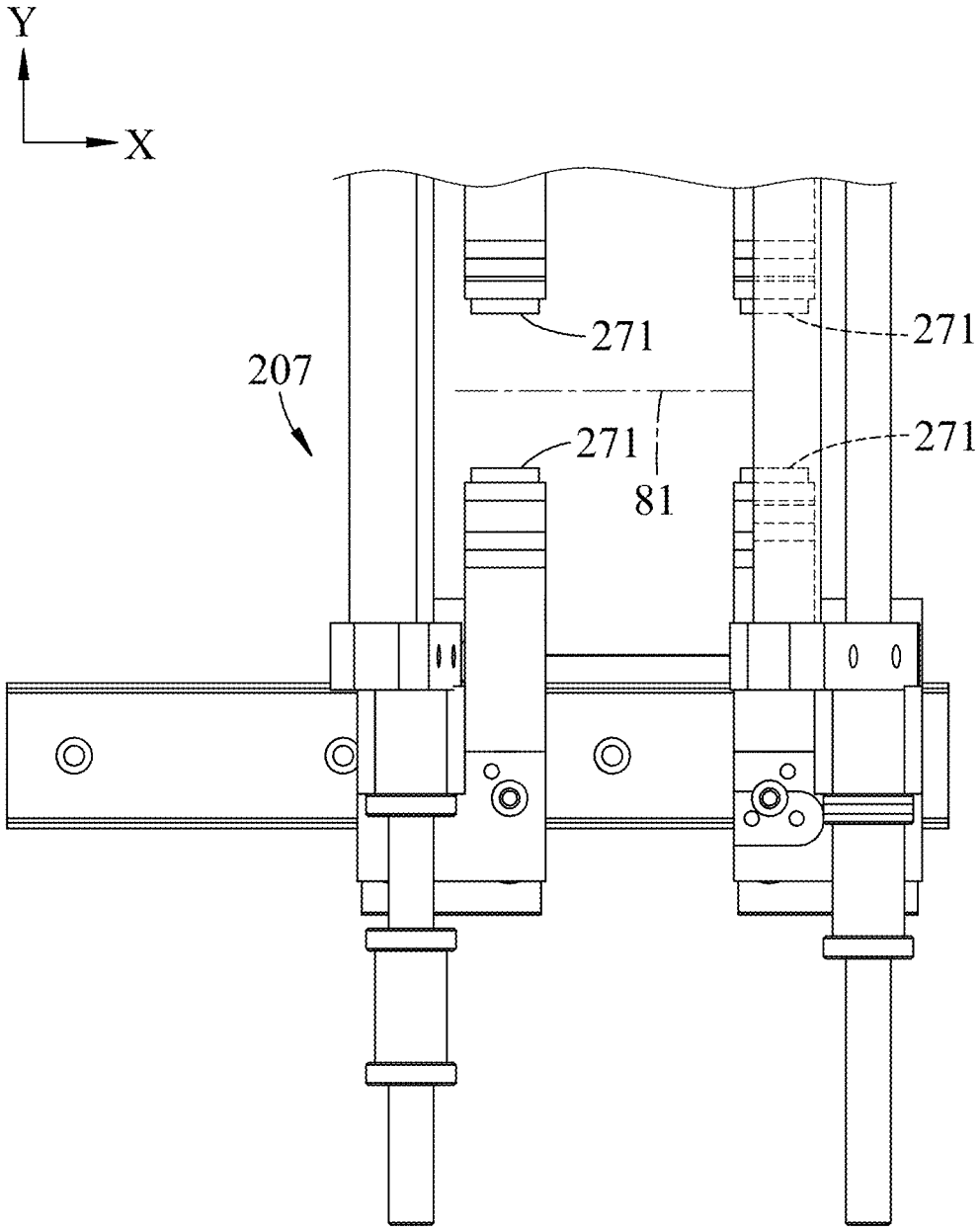
FIG. 14 is a fragmentary top view of a package expansion device of the embodiment for pulling and straightening a top end of each package.

Referring to FIG. 14, in combination with FIG. 3, the package expansion device 207 is disposed on the base 4, and is located between the filling device 206 and the discharge end 42. The package expansion device 207 is configured to pull and straighten a top end of each package 81, and includes four pull members 271 that are movable in the horizontal direction (X) and the transverse direction (Y) and that are spaced apart in the horizontal direction (X) and the transverse direction (Y). The pull members 271 of this embodiment are configured as clamping blocks. After the pull members 271 cooperatively clamp the front and back surfaces of the upper portion of each package 81, the pull members 271 are then moved sideways in opposite directions to pull and straighten the top end of each package 81.

Figure 15:
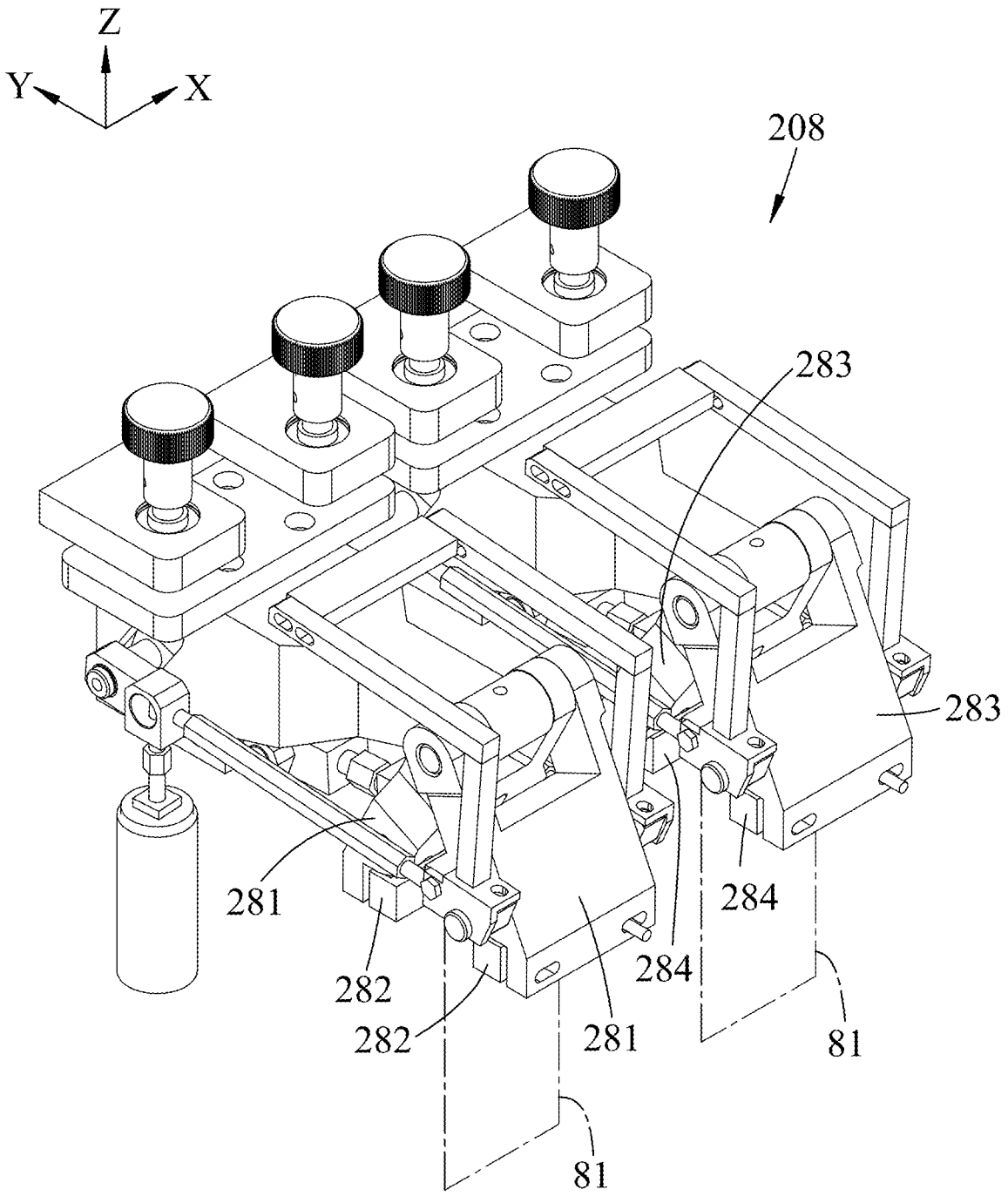
FIG. 15 is a schematic perspective view of a top sealing device of the embodiment for hot pressing the top end of each package.

Referring to FIG. 15, in combination with FIG. 3, the top sealing device 208 is disposed on the base 4, and is located between the package expansion device 207 and the discharge end 42. The top sealing device 208 includes two top sealing clamping seats 281 pivotable relative to each other, two top heating blocks 282 respectively fixed to the top sealing clamping seats 281 and extending in the horizontal direction (X), two cold sealing clamping seats 283 spaced apart from the top sealing clamping seats 281 in the horizontal direction (X) and pivotable relative to each other, and two top pressing blocks 284 respectively fixed to the cold sealing clamping seats 283 and extending in the horizontal direction (X). Specifically, the cold sealing clamping seats 283 together with the top pressing blocks 284 are located between the top sealing clamping seats 281 and the discharge end 42. When the top sealing clamping seats 281 are driven to pivot relative to each other through a cam mechanism (not shown), the top heating blocks 282 are driven to move toward each other in the transverse direction (Y) so as to clamp therebetween each package 81 and hot press the top end of each package 81, thereby thermally welding the top end of each package 81. When the cold sealing clamping seats 283 are driven to pivot relative to each other through a cam mechanism (not shown), the top pressing blocks 284 are driven to move toward each other in the transverse direction (Y) so as to clamp and press the top end of each package 81, thereby improving the flatness of the top end of each package 81 after thermal welding. In some variations, the cold sealing clamping seats 283 and the top pressing blocks 284 of the top sealing device 208 may be omitted.

With reference to FIGS. 2 and 3, the discharge device 209 is disposed on the discharge end 42, and is adjacent to the driver 251 of the package receiving device 205. The discharge device 209 includes a suction member unit 291 movable relative to the base 4 for sucking and releasing each package 81, and a conveying belt 292 located below the suction member unit 291 for receiving the packages 81 released by the suction member unit 291.

The control system 3 is electrically connected to the horizontal packaging system 200 and the film conveying mechanism 1 (see FIG. 4), and includes a cantilever 31 movably mounted on the base 4, and a controller 32 fixed to the cantilever 31 for controlling the horizontal packaging system 200 and the film conveying mechanism 1.

With the control system 3 controlling the synchronous operation of the horizontal packaging system 200 and the film conveying mechanism 1, and after the folded film material 8 is conveyed into the horizontal packaging system 200, the packaging processes, such as the bottom sealing, the hot vertical sealing, the cold vertical sealing, the film cutting, the opening of the package, the filling, the expanding of the package, and the top sealing, can be performed in sequence in the horizontal direction (X), so that each package 81 filled with the filling material can be produced and an automated continuous production can be realized. Of course, in some variations, a date printing device or a tearable punch-out device may also be added depending on the packaging requirements.

It should be particularly noted that the clamping and moving device 201 is configured to generate an action force to push the continuous folded film material 8 from the feed end 41 toward the film cutting device 204 during the bottom sealing, the hot vertical sealing, the cold vertical sealing, and the film cutting processes. The package receiving device 205 is configured to transport the packages 81 during the opening of the package, the filling, the expanding of the package, and the top sealing processes.

In summary, the continuous horizontal packaging machine of this disclosure uses the upper suction members 513 of the package opening device 5 to suck the front and back surfaces of the upper portion of each package 81 and uses the lower suction members 535 to suck the front and back surfaces of the lower portion of each package 81, and simultaneously, uses the pushing blocks 523 to push and squeeze the left and right sides of each package 81, so that the upper and lower portions and the left and right sides of each package 81 can be ensured to open and expand to thereby prevent each package 81 from bending in the middle portion thereof. Thus, the effect of opening each package 81 is good, and the filling material can be smoothly and completely filled in the subsequent filling process to increase the product yield. Therefore, the object of this disclosure can indeed be achieved.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A continuous horizontal packaging machine suitable for forming a continuous folded film material into a plurality of packages, for filling each of the packages with a filling material, and for sealing each of the packages filled with the filling material, said continuous horizontal packaging machine comprising a horizontal packaging system, said horizontal packaging system including:

a base having a feed end, and a discharge end opposite to said feed end in a horizontal direction;

a clamping and moving device disposed on said base and including two roller shafts extending in a height direction perpendicular to the horizontal direction, said roller shafts being rotatable in opposite directions to clamp therebetween the folded film material and being configured to intermittently move the folded film material in the horizontal direction;

a vertical sealing device disposed on said base and located between said feed end and said clamping and moving device, said vertical sealing device including two side heating blocks extending in the height direction, said side heating blocks being relatively movable toward each other in a transverse direction perpendicular to the horizontal direction and the height direction for hot pressing lateral sides of the folded film material;

a film cutting device disposed on said base and located between said clamping and moving device and said discharge end, said film cutting device being configured to cut the folded film material to form the packages;

a package receiving device configured to drive the packages to intermittently move in the horizontal direction and including two slide seats spaced apart in the transverse direction and extending in the horizontal direction, and a driven rod interconnecting said slide seats and configured to drive said slide seats to move toward or away from each other in the transverse direction so as to clamp or release the packages, said slide seats being further driven to move back and forth in the horizontal direction for conveying the packages;

a package opening device disposed on said base and located between said film cutting device and said discharge end, said package opening device being configured to open each of the packages and including an upper package opening unit having two upper suction members relatively movable in the transverse direction, a squeezing unit having two pushing blocks relatively movable in the horizontal direction, and a lower package opening unit having two lower suction members relatively movable in the transverse direction and lower than said two upper suction members in the height direction;

a filling device disposed on said base and located between said package opening device and said discharge end, said filling device being configured to fill each of the packages with the filling material; and a top sealing device disposed on said base and located between said filling device and said discharge end, said top sealing device including two top heating blocks relatively movable in the transverse direction for hot pressing a top end of each of the packages.

2. The continuous horizontal packaging machine as claimed in claim 1, wherein said horizontal packaging system further includes a bottom sealing device disposed on said base and located between said feed end and said clamping and moving device, said bottom sealing device including two bottom heating blocks extending in the horizontal direction and relatively movable in the transverse direction for hot pressing a bottom end of the folded film material.

3. The continuous horizontal packaging machine as claimed in claim 1, wherein said horizontal packaging system further includes a package expansion device disposed on said base and located between said filling device and said top sealing device, said package expansion device being configured to pull and straighten the top end of each of the packages and including four pull members spaced apart from each other in the horizontal direction and the transverse direction.

4. The continuous horizontal packaging machine as claimed in claim 1, wherein said horizontal packaging system further includes a discharge device disposed on said discharge end, said discharge device including a suction member unit movable relative to said base for sucking and releasing each of the packages, and a conveying belt located below said suction member unit for receiving the packages released by said suction member unit.

5. The continuous horizontal packaging machine as claimed in claim 1, further comprising a film conveying mechanism adjacent to said feed end and including a feed shaft for a film material roll to be sleeved thereon, and a plurality of spaced-apart rotating rollers for the film material to be wound thereon, wherein, when said feed shaft and said rotating rollers are rotated, said rotating rollers are configured to convey the film material pulled out from the film material roll and then fold in half the film material before being sent into said horizontal packaging system.

6. The continuous horizontal packaging machine as claimed in claim 1, wherein said vertical sealing device further includes two side pressing blocks located between said side heating blocks and said clamping and moving device, said side pressing blocks extending in the height direction and being relatively movable in the transverse direction for pressing the lateral sides of the folded film material.

7. The continuous horizontal packaging machine as claimed in claim 1, wherein said top sealing device further includes two top pressing blocks located between said top heating blocks and said discharge end, said top pressing blocks extending in the horizontal direction and being relatively movable in the transverse direction for pressing the top end of each of the packages.

8. The continuous horizontal packaging machine as claimed in claim 1, wherein said package receiving device further includes an electrically powered driver, said electrically powered driver being a servo motor, and having a drive body and a carrier slidably disposed on said drive body.

9. The continuous horizontal packaging machine as claimed in claim 1, wherein said package receiving device further includes a carrier driven by electricity to move in the horizontal direction, a connecting plate fixed to said carrier, and two spaced-apart pull rods pivotally connected between said connecting plate and said slide seats, said pull rods being driven by said carrier to move said slide seats back and forth in the horizontal direction.

10. A package opening device of a continuous horizontal packaging machine, comprising:

an upper package opening unit including two upper slide blocks relatively movable in a transverse direction, and two upper suction members respectively fixed to said upper slide blocks and driven by said upper slide blocks to relatively move in the transverse direction;

a squeezing unit including a guide rail extending in a horizontal direction perpendicular to the transverse direction, and two pushing blocks slidably disposed on said guide rail and movable relative to each other; and a lower package opening unit lower than said upper package opening unit in a height direction perpendicular to the horizontal direction and the transverse direction, and including two lower slide blocks relatively movable in the transverse direction, and two lower suction members respectively fixed to said lower slide blocks and driven by said lower slide blocks to relatively move in the transverse direction.

* * * * *